US010428508B1

(12) United States Patent
Hudson

(10) Patent No.: US 10,428,508 B1
(45) Date of Patent: Oct. 1, 2019

(54) HEIGHT ADJUSTABLE TOILET ASSEMBLY

(71) Applicant: Polly Hudson, Arlington, GA (US)

(72) Inventor: Polly Hudson, Arlington, GA (US)

( * ) Notice: Subject to any disclaimer, the term of this patent is extended or adjusted under 35 U.S.C. 154(b) by 0 days.

(21) Appl. No.: 15/954,368

(22) Filed: Apr. 16, 2018

(51) Int. Cl.
*E03D 11/12* (2006.01)
*E03D 11/16* (2006.01)
*E03C 1/324* (2006.01)

(52) U.S. Cl.
CPC ..... *E03D 11/125* (2013.01); *E03C 1/324* (2013.01); *E03D 11/16* (2013.01)

(58) Field of Classification Search
USPC ..... 4/420
See application file for complete search history.

(56) References Cited

U.S. PATENT DOCUMENTS 4,185,335 A 1/1980 Alvis
4,192,027 A * 3/1980 Sargent ..... E03D 5/012 4/438
4,726,079 A 2/1988 Signori
4,909,268 A * 3/1990 Maggio ..... A01M 31/02 135/902
4,979,242 A * 12/1990 Maggio ..... E04H 1/1244 135/901
4,982,456 A * 1/1991 Cameron ..... E03D 5/01 220/373
5,031,251 A 7/1991 Williams
5,063,617 A 11/1991 Ward
5,592,703 A 1/1997 Jones
D383,835 S 9/1997 Gibbs
5,737,780 A 4/1998 Okita
6,158,061 A * 12/2000 Cameron ..... E03D 5/01 4/300
6,385,790 B1 * 5/2002 Abraham ..... A47K 11/02 4/484
6,745,417 B2 6/2004 Sumino
8,336,130 B1 12/2012 Cardenas
9,650,777 B1 5/2017 Roberts
2008/0178379 A1 * 7/2008 Davis ..... A47K 11/06 4/483
2008/0301865 A1 * 12/2008 Hand ..... E03D 9/052 4/216
2009/0300835 A1 * 12/2009 Belpasso ..... E03F 1/006 4/431
2012/0151667 A1 * 6/2012 Berry ..... E03D 1/30 4/406
2012/0198609 A1 * 8/2012 Grimaldi ..... E03D 11/12 4/420
2013/0227773 A1 * 9/2013 Park ..... E03D 5/012 4/353

* cited by examiner

*Primary Examiner* — Lori L Baker

(57) ABSTRACT

A height adjustable toilet assembly for a person with a disability includes a commode that comprises a bowl. A plate is coupled to a bottom of the bowl. A base is coupled to a floor of a structure. A pump is coupled to the base. A hydraulic cylinder is coupled to and extend perpendicularly between the base and the plate. The hydraulic cylinder is operationally coupled to the pump. The pump is positioned to actuate the hydraulic cylinder to selectively extend the commode from the base. A bellows is coupled to and extend between a perimeter of the base and a circumference of the bottom of the bowl. The bellows is positioned to extend as the commode is extended from the base.

11 Claims, 5 Drawing Sheets

HEIGHT ADJUSTABLE TOILET ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to toilet assemblies and more particularly pertains to a new toilet assembly for a person with a disability.

BRIEF SUMMARY OF THE INVENTION

An embodiment of the disclosure meets the needs presented above by generally comprising a commode, which in turn comprises a bowl. A plate is coupled to a bottom of the bowl. A base is coupled to a floor of a structure. A pump is coupled to the base. A hydraulic cylinder is coupled to and extend perpendicularly between the base and the plate. The hydraulic cylinder is operationally coupled to the pump. The pump is positioned to actuate the hydraulic cylinder to selectively extend the commode from the base. A bellows is coupled to and extend between a perimeter of the base and a circumference of the bottom of the bowl. The bellows is positioned to extend as the commode is extended from the base.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
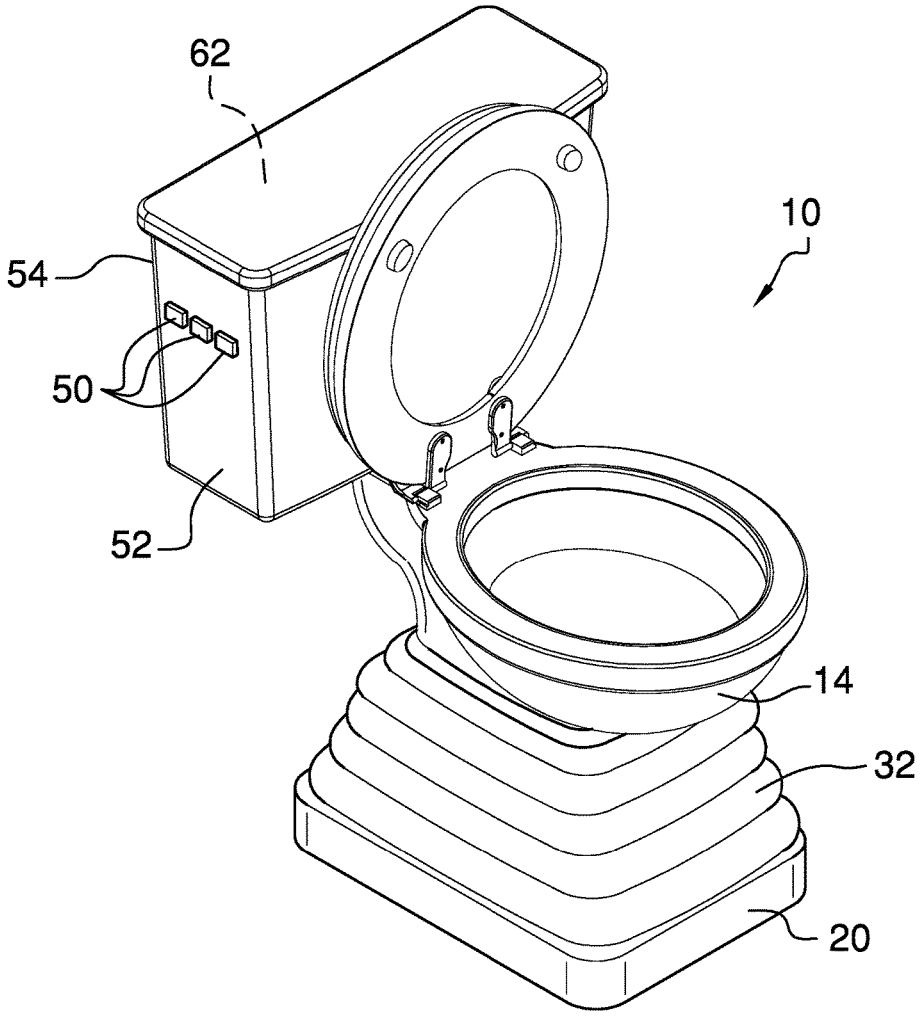
FIG. 1 is an isometric perspective view of a height adjustable toilet assembly according to an embodiment of the disclosure.

With reference now to the drawings, and in particular to FIGS. 1 through 5 thereof, a new toilet assembly embodying the principles and concepts of an embodiment of the disclosure and generally designated by the reference numeral 10 will be described.

Figure 2:
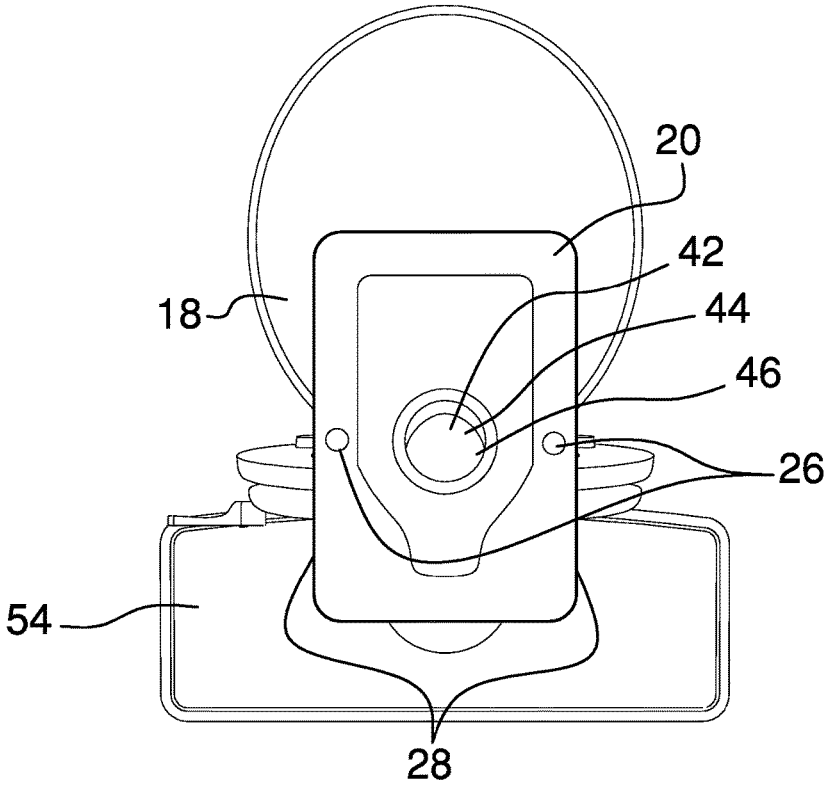
FIG. 2 is a bottom view of an embodiment of the disclosure.
Figure 3:
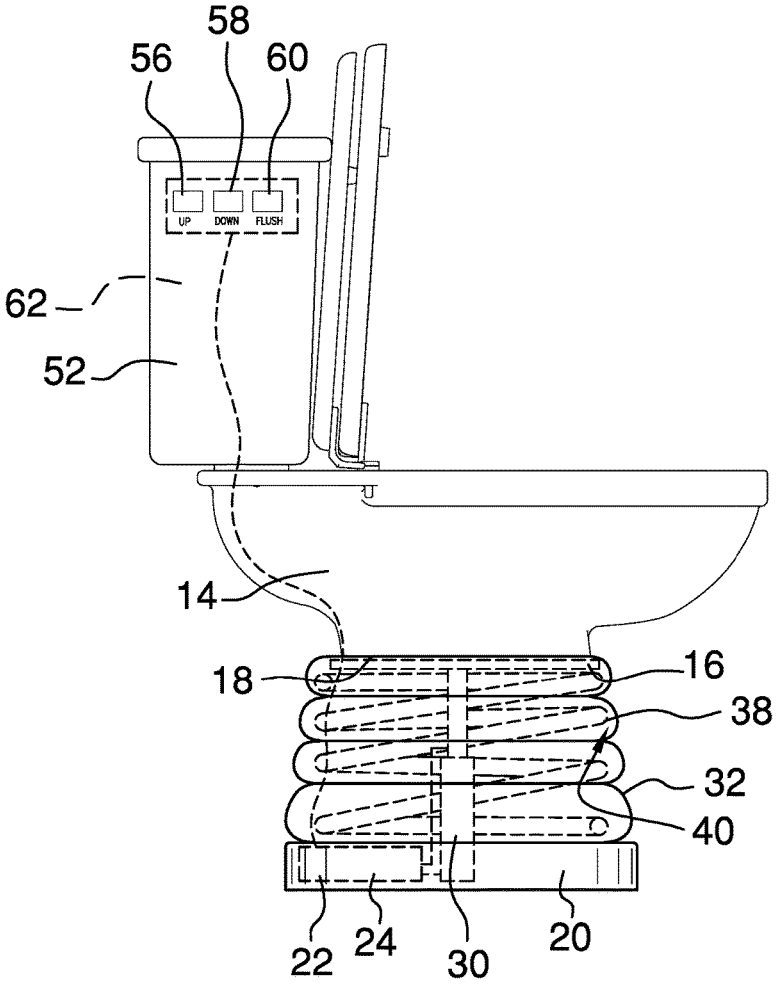
FIG. 3 is a side view of an embodiment of the disclosure.
Figure 4:
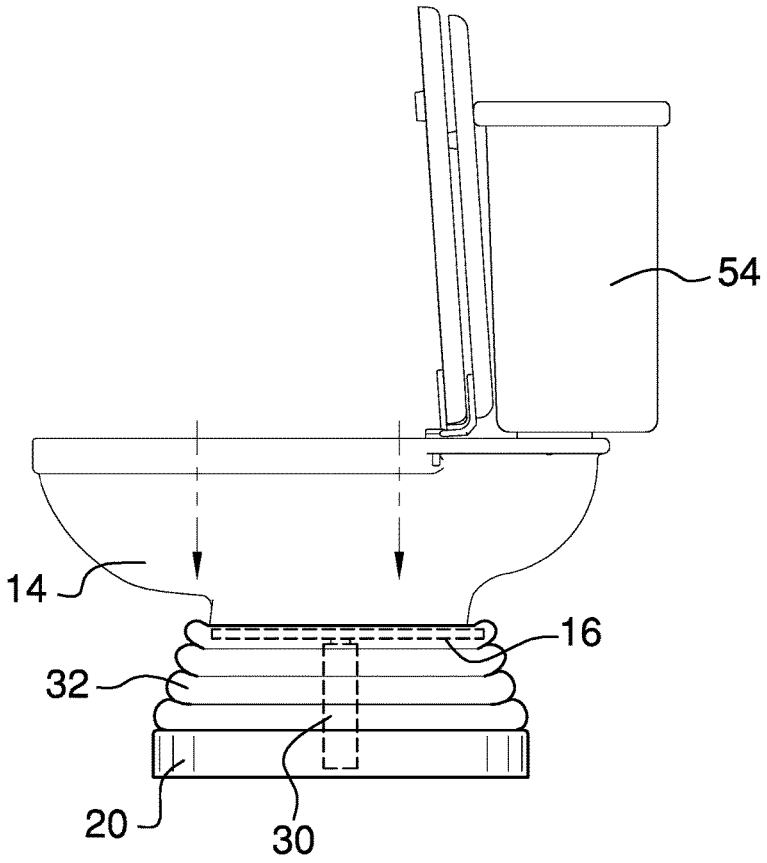
FIG. 4 is a side view of an embodiment of the disclosure.

As best illustrated in FIGS. 1 through 5, the height adjustable toilet assembly 10 generally comprises a commode 12, which in turn comprises a bowl 14. A plate 16 is coupled to a bottom 18 of the bowl 14, as shown in FIG. 3. A base 20 is coupled to a floor of a structure, such the floor of a bathroom in a residence. A pump 22 is coupled to the base 20. The pump 22 is positioned in a hollow 24 that is positioned in the base 20.

A plurality of holes 26 is positioned through the base 20. The plurality of holes 26 comprises two holes 26 that are positioned singly proximate to opposing sides 28 of the base 20, as shown in FIG. 2. Each hole 26 is configured to insert a respective item of mounting hardware to couple the base 20 to the floor of the structure.

A hydraulic cylinder 30 is coupled to and extend perpendicularly between the base 20 and the plate 16, as shown in FIG. 3. The hydraulic cylinder 30 is operationally coupled to the pump 22. The pump 22 is positioned to actuate the hydraulic cylinder 30 to selectively extend the commode 12 from the base 20.

Figure 5:
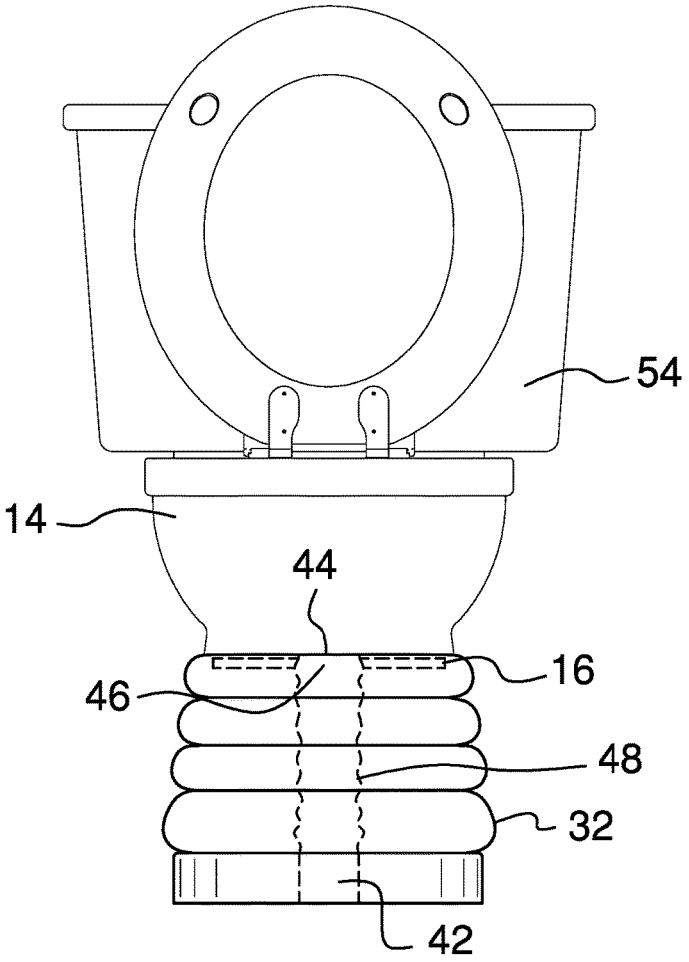
FIG. 5 is a front view of an embodiment of the disclosure.

A bellows 32 is coupled to and extend between a perimeter 34 of the base 20 and a circumference 36 of the bottom 18 of the bowl 14. The bellows 32 comprises rubber. The bellows 32 is positioned to extend as the commode 12 is extended from the base 20, as shown in FIG. 5.

A spring 38 is coupled to an inner face 40 of the bellows 32 and extends from proximate to the base 20 to proximate to the plate 16, as shown in FIG. 3. The spring 38 is positioned to bias the bellows 32 to an extended configuration.

A first aperture 42 is positioned through the base 20. The first aperture 42 is aligned with a drain pipe. A second aperture 44 is positioned through the bottom 18 of the bowl 14. A third aperture 46 is positioned through the plate 16. The third aperture 46 is complementary to and aligned with the second aperture 44. A tube 48 is coupled to and extend between the base 20 and the plate 16. The tube 48 is aligned with the first aperture 42 and the third aperture 46 so that the bowl 14 is in fluidic communication with the drain pipe to selectively drain contents of the bowl 14. The tube 48 is flexible so that the tube 48 is positioned to extend as the commode 12 is extended from the base 20.

A controller 50 is coupled to the commode 12. The controller 50 is positioned on a side 52 of a tank 54 of the commode 12, as shown in FIG. 1. The controller 50 is operationally coupled to the pump 22 and a flush assembly 62 of the commode 12. The present invention also anticipates the controller 50 being wirelessly operationally coupled to the pump 22 and the flush assembly 62 of the commode 12. The controller 50 is positioned to actuate the pump 22 to selectively extend the commode 12 from the base 20. The controller 50 also is positioned to actuate the flush assembly 62 to drain the contents for the bowl 14 through the tube 48 to the drain pipe.

The controller 50 comprises a first button 56, a second button 58, and a third button 60. The first button 56, the second button 58, and the third button 60 are depressible. The first button 56 is configured to be depressed to signal the pump 22 to actuate the hydraulic cylinder 30 to selectively extend the commode 12 from the base 20. The second button 58 is configured to be depressed to signal the pump 22 to actuate the hydraulic cylinder 30 to selectively lower the commode 12 to the base 20. The third button 60 is configured to be depressed to signal the flush assembly 62 to drain the contents for the bowl 14 through the tube 48 to the drain pipe.

In use, the first button 56 is configured to be depressed to signal the pump 22 to actuate the hydraulic cylinder 30 to selectively extend the commode 12 from the base 20 to a height that is suitable for a user. The second button 58 is configured to be depressed to signal the pump 22 to actuate the hydraulic cylinder 30 to selectively lower the commode 12 to the base 20. The third button 60 is configured to be depressed to signal the flush assembly to drain the contents for the bowl 14 through the tube 48 to the drain pipe.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A height adjustable toilet assembly comprising:

a commode comprising a bowl;

a plate coupled to a bottom of said bowl;

a base coupled to a floor of a structure;

a pump coupled to said base;

a hydraulic cylinder coupled to and extending perpendicularly between said base and said plate, said hydraulic cylinder being operationally coupled to said pump wherein said pump is positioned for actuating said hydraulic cylinder for selectively extending said commode from said base; and a bellows coupled to and extending between a perimeter of said base and a circumference of said bottom of said bowl wherein said bellows is positioned for extending as said commode is extended from said base.

2. The assembly of claim 1, further including said pump being positioned in a hollow positioned in said base.

3. The assembly of claim 1, further including a plurality of holes positioned through said base wherein each said hole is configured for inserting a respective item of mounting hardware for coupling said base to the floor of the structure.

4. The assembly of claim 3, further including said plurality of holes comprising two said holes positioned singly proximate to opposing sides of said base.

5. The assembly of claim 1, further including said bellows comprising rubber.

6. The assembly of claim 1, further including a spring coupled to an inner face of said bellows and extending from proximate to said base to proximate to said plate such that said spring is positioned for biasing said bellows to an extended configuration.

7. The assembly of claim 1, further comprising:

a first aperture positioned through said base such that said first aperture is aligned with a drain pipe;

a second aperture positioned through said bottom of said bowl;

a third aperture positioned through said plate, said third aperture being complementary to and aligned with said second aperture;

a tube coupled to and extending between said base and said plate such that said tube is aligned with said first aperture and said third aperture wherein said bowl is in fluidic communication with the drain pipe for selectively draining contents of said bowl, said tube being flexible such that said tube is positioned for extending as said commode is extended from said base.

8. The assembly of claim 1, further including a controller coupled to said commode, said controller being operationally coupled to said pump and a flush assembly of said commode wherein said controller is positioned for actuating said pump for selectively extending said commode from said base and for actuating said flush assembly for draining the contents for said bowl through said tube to the drain pipe.

9. The assembly of claim 8, further including said controller being positioned on a side of a tank of said commode.

10. The assembly of claim 8, further including said controller comprising a first button, a second button, and a third button, said first button, said second button, and said third button being depressible, wherein said first button is configured for depressing for signaling said pump for actuating said hydraulic cylinder for selectively extending said commode from said base, wherein said second button is configured for depressing for signaling said pump for actuating said hydraulic cylinder for selectively lowering said commode to said base, wherein said third button is configured for depressing for signaling said flush assembly for draining the contents for said bowl through said tube to the drain pipe.

11. A height adjustable toilet assembly comprising:

a commode comprising a bowl;

a plate coupled to a bottom of said bowl;

a base coupled to a floor of a structure;

a pump coupled to said base, said pump being positioned in a hollow positioned in said base;

a plurality of holes positioned through said base wherein each said hole is configured for inserting a respective item of mounting hardware for coupling said base to the floor of the structure, said plurality of holes comprising two said holes positioned singly proximate to opposing sides of said base;

a hydraulic cylinder coupled to and extending perpendicularly between said base and said plate, said hydraulic cylinder being operationally coupled to said pump wherein said pump is positioned for actuating said hydraulic cylinder for selectively extending said commode from said base;

a bellows coupled to and extending between a perimeter of said base and a circumference of said bottom of said bowl wherein said bellows is positioned for extending as said commode is extended from said base, said bellows comprising rubber;

a spring coupled to an inner face of said bellows and extending from proximate to said base to proximate to said plate such that said spring is positioned for biasing said bellows to an extended configuration;

a first aperture positioned through said base such that said first aperture is aligned with a drain pipe;

a second aperture positioned through said bottom of said bowl;

a third aperture positioned through said plate, said third aperture being complementary to and aligned with said second aperture;

a tube coupled to and extending between said base and said plate such that said tube is aligned with said first aperture and said third aperture wherein said bowl is in fluidic communication with the drain pipe for selectively draining contents of said bowl, said tube being flexible such that said tube is positioned for extending as said commode is extended from said base;

a controller coupled to said commode, said controller being operationally coupled to said pump and a flush assembly of said commode wherein said controller is positioned for actuating said pump for selectively extending said commode from said base and for actuating said flush assembly for draining the contents for said bowl through said tube to the drain pipe, said controller being positioned on a side of a tank of said commode, said controller comprising a first button, a second button, and a third button, said first button, said second button, and said third button being depressible, wherein said first button is configured for depressing for signaling said pump for actuating said hydraulic cylinder for selectively extending said commode from said base, wherein said second button is configured for depressing for signaling said pump for actuating said hydraulic cylinder for selectively lowering said commode to said base, wherein said third button is configured for depressing for signaling said flush assembly for draining the contents for said bowl through said tube to the drain pipe; and wherein said first button is configured for depressing for signaling said pump for actuating said hydraulic cylinder for selectively extending said commode from said base, wherein said second button is configured for depressing for signaling said pump for actuating said hydraulic cylinder for selectively lowering said commode to said base, wherein said third button is configured for depressing for signaling said flush assembly for draining the contents for said bowl through said tube to the drain pipe.

* * * * *